US010522312B1

(12) United States Patent
Wu

(10) Patent No.: US 10,522,312 B1
(45) Date of Patent: Dec. 31, 2019

(54) MOVABLE SPRING PLATE AND RELAY THEREOF

(71) Applicant: SONG CHUAN PRECISION CO., LTD., New Taipei (TW)

(72) Inventor: Sung-Jen Wu, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 79 days.

(21) Appl. No.: 16/005,709

(22) Filed: Jun. 12, 2018

(51) Int. Cl.

| | |
|---|---|
| ***H01H 1/24*** | (2006.01) |
| ***H01H 50/64*** | (2006.01) |
| ***H01H 51/01*** | (2006.01) |
| ***H01H 50/58*** | (2006.01) |
| ***H01H 9/34*** | (2006.01) |
| ***H01H 51/28*** | (2006.01) |

(52) U.S. Cl.
CPC ..... *H01H 50/64* (2013.01); *H01H 9/34* (2013.01); *H01H 50/58* (2013.01); *H01H 51/01* (2013.01); *H01H 51/287* (2013.01)

(58) Field of Classification Search
CPC ..... H01H 2001/247–2001/265; H01H 1/50–1/502; H01H 51/287
See application file for complete search history.

(56) References Cited

U.S. PATENT DOCUMENTS 7,986,204 B2 * 7/2011 Mader ..... H01H 50/043 335/78
2005/0190026 A1 * 9/2005 Mikl ..... H01H 50/56 335/128

* cited by examiner

*Primary Examiner* — Ramon M Barrera
(74) *Attorney, Agent, or Firm* — Fei-hung Yang

(57) ABSTRACT

A movable spring plate structure for defining an open or closed state with respect to a fixed contact includes a rigid spring plate contact portion, a soft spring plate warp portion, a soft spring plate force-applying portion and a movable contact. The soft spring plate warp portion is coupled to the rigid spring plate contact portion, and a first deformation gap is formed between the rigid and soft spring plate contact portions. The rigid spring plate contact portion is harder than the soft spring plate warp portion. The soft spring plate force-applying portion is disposed at the soft spring plate warp portion, and the movable contact is disposed at the rigid spring plate contact portion. A force applied to the soft spring plate force-applying portion drives the movable and fixed contacts into a closed state.

9 Claims, 4 Drawing Sheets

MOVABLE SPRING PLATE AND RELAY THEREOF

FIELD OF INVENTION

The present invention relates to the field of relays, in particular to a movable spring plate structure and its relay capable of extinguishing electric arcs and providing a good conduction contact.

BACKGROUND OF INVENTION

1. Description of the Related Art

In general, electronic devices are used to help us in our daily life, and relay is one of the most widely used electronic devices. The relay is used to control a smaller current circuit system and control another circuit system by an open or closed state. After an electromagnetic relay is connected to a small current circuit, an electromagnetic device produces an electromagnetic effect to drive a movable connector to contact a fixed connector in the relay in order to conduct another controlled circuit system which is electrically coupled to the connector, and vice versa.

However, when the circuit system controlled by the relay is electrically conducted, the connectors are contacted with each other to produce an electric arc during the electrical conduction, or when the connectors are in the closed state, the directions of transmitting the current are different and thus a repulsive force is produced, so that the connectors are no longer attached to each other, and the electric arc may cause damages to the relay or even to the whole circuit system. In addition, if the controlled circuit transmits a high current, the energy of the electric arc will be very large and may cause a severer damage.

Therefore, solutions are provided in hope of overcoming the aforementioned problem. For example, a permanent magnet is installed adjacent to the two connectors to reduce the electric arc, but when the circuit system is electrically conducted, the magnetic field of the permanent magnet still interferes with the connectors, and the conventional relay is still unable to extinguish the electric arc effectively. As a result, the conventional relay has a low efficiency and a short service life.

In view of the aforementioned drawbacks of the conventional relay, the inventor of the present invention conducts extensive research and experiment based on years of experience in the related industry, and finally developed a movable spring plate structure and its relay to overcome the drawbacks of the prior art.

2. Summary of the Invention

Therefore, it is a primary objective of the present invention to provide a movable spring plate structure and its relay capable of preventing electric arcs, and improving the life and performance of the relay.

To achieve the aforementioned and other objectives, the present invention provides a movable spring plate structure applied to a relay for defining an open or closed state with respect to a fixed contact, comprising: a rigid spring plate contact portion; a soft spring plate warp portion, coupled to the rigid spring plate contact portion, and having a first deformation gap formed between the rigid spring plate contact portion and the soft spring plate warp portion, and the rigid spring plate contact portion having a hardness greater than the hardness of the soft spring plate warp portion; a soft spring plate force-applying portion, disposed at the soft spring plate warp portion; and a movable contact, disposed at the rigid spring plate contact portion; wherein, when the soft spring plate force-applying portion is driven by a force, and the movable contact and the fixed contact are set into a closed state, the soft spring plate warp portion produces a deformation with respect to the rigid spring plate contact portion. Therefore, the soft spring plate warp portion withstands most of the deformation and secures the movable contact to extinguish the electric arc, so as to improve the performance and life of the relay.

In addition, the rigid spring plate contact portion is a plate stacked on a part of the soft spring plate warp portion, and the plate has a hardness greater than a hardness of the soft spring plate warp portion to further secure the movable contact.

In addition, the movable spring plate structure further comprises a second deformation gap disposed at the rigid spring plate contact portion and configured to be adjacent to the movable contact to increase the deformation space of the movable spring plate structure.

Further, the second deformation gap is in an arc shape and communicated to the first deformation gap and surrounds the movable contact to increase the deformation space of the movable spring plate structure significantly.

In another implementation mode, the second deformation gap is in an arc shape and not communicated to the first deformation gap and surrounds the movable contact, so as to increase the deformation space of the rigid spring plate contact portion.

In addition, the movable spring plate structure further comprises a connecting portion coupled to the soft spring plate warp portion, and the connecting portion having a hardness smaller than the hardness of the rigid spring plate contact portion and being L-shaped. Therefore, the force applied to the movable spring plate structure can be buffered to increase the deformation space.

The present invention also discloses a relay with at least one of the movable spring plate structure, and the relay comprises a base, at least one electromagnetic structure, and at least one pushing assembly. Wherein, the base is provided for installing the movable spring plate structure and at least one fixed contact, and the electromagnetic structure is installed at the base and configured to be corresponsive to the movable spring plate structure. An end of the pushing assembly is coupled to the soft spring plate force-applying portion. Therefore, after the electromagnetic structure is electrically conducted, the electromagnetic effect of the electromagnetic structure magnetically attracts and drives the movable contact and the fixed contact to form an open or closed state. The flexibility of the movable spring plate structure is used to extinguish the electric arc, so as to improve the performance and life of the relay.

In addition, the relay further comprises a fastener disposed at the base and having an end coupled to the movable spring plate structure, and having a current in an opposite direction when the movable contact and the fixed contact are in a closed state, and the fastener is electrically conducted with the movable spring plate structure, so as to produce an electromagnetic force that pushes in a parallel direction towards the movable contact to improve the stability between the movable contact and the fixed contact to offset the electromagnetic repulsion between the movable contact and the fixed contact and improve the stability between the movable contact and the fixed contact.

When the movable spring plate structure comes with a plural quantity, the base comprises at least one spacer for separating any two adjacent movable spring plate structures to reduce the electric arc occurred between the movable spring plate structures.

In summation, the movable spring plate structure and its relay in accordance with the present invention utilize the flexibility and rigidity of the movable spring plate structure to produce a partial deformation to secure the movable contact, so as to extinguish the electric arc. Further, the movable spring plate structure can further improve the stability of the aforementioned contact devices, the invention can extinguish the electric arc and minimize the damage to the contact devices, so as to improve the performance and life of the relay.

DESCRIPTION OF THE PREFERRED EMBODIMENTS

Figure 1:
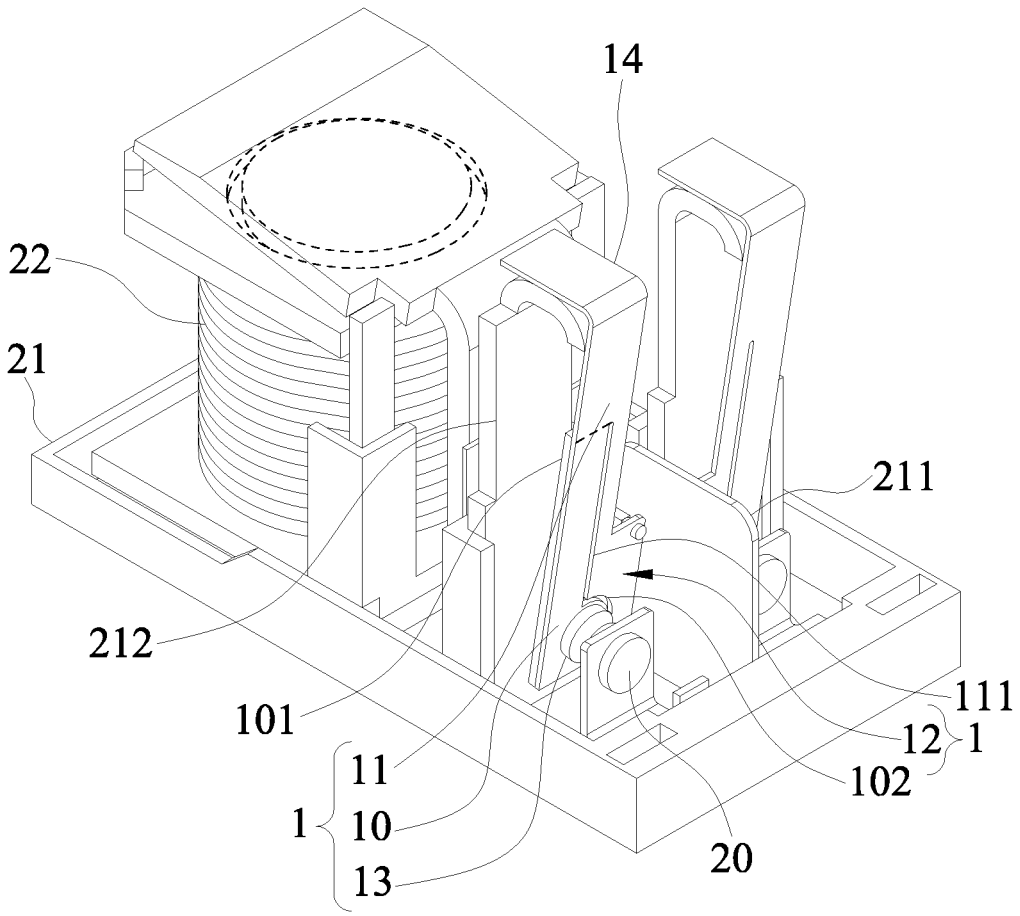
FIG. 1 is a perspective view of a relay in accordance with a preferred embodiment of the present invention.
Figure 2:
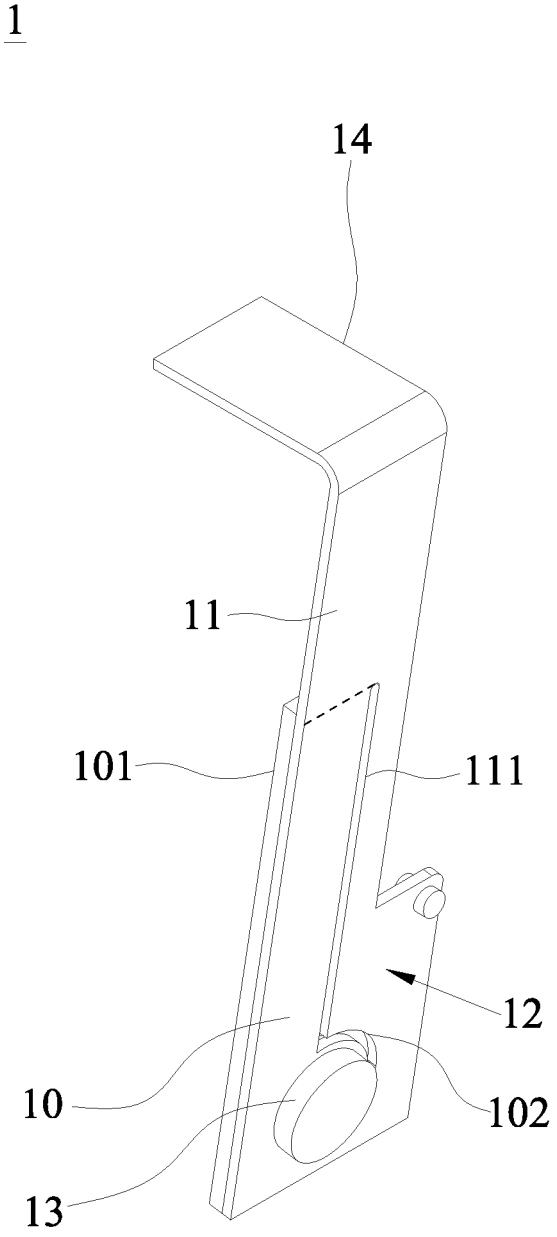
FIG. 2 is a perspective view of a movable spring plate structure in accordance with a preferred embodiment of the present invention.

To make it easier for our examiner to understand the objective, technical characteristics, structure, innovative features, and performance of the invention, we use preferred embodiments together with the attached drawings for the detailed description of the invention.

With reference to FIGS. 1, 2 and 3A to 3C for a perspective view of a relay, a perspective view of a movable spring plate structure, and schematic views of a using status in accordance with a preferred embodiment of the present invention respectively, the present invention discloses a movable spring plate structure 1 and its relay 2 capable of extinguish electric arcs to improve the performance and life of the relay 2. The relay 2 comprises at least one the movable spring plate structure 1, a base 21, at least one electromagnetic structure 22, and a pushing assembly 23. The movable spring plate structure 1 is applied to the relay 2 and provided for defining an open or closed state with respect to a fixed contact 20, and the movable spring plate structure comprises a rigid spring plate contact portion 10, and a soft spring plate warp portion 11, a soft spring plate force-applying portion 12 and the movable contact 13. The soft spring plate warp portion 11 is coupled to the rigid spring plate contact portion 10, and a first deformation gap 111 is formed between the soft spring plate warp portion 11 and the rigid spring plate contact portion 10, wherein the rigid spring plate contact portion 10 has a hardness greater than the hardness of the soft spring plate warp portion 11. In addition, the soft spring plate force-applying portion 12 is disposed at the soft spring plate warp portion 11, and the movable contact 13 is disposed at the rigid spring plate contact portion 10. Wherein, the movable contact 13 and the fixed contact 20 are abbreviated to contact devices, and when the soft spring plate force-applying portion 12 is driven by a force to set the contact devices into a closed state, the soft spring plate warp portion 11 will produce a deformation with respect to the rigid spring plate contact portion 10. Therefore, the high flexibility and partial deformation of the movable spring plate structure 1 can prevent producing an electric arc to protect the relay 2 and any circuit system connected to the relay 2, and further improve the performance and life of the relay 2.

In FIG. 1, the base 21 is provided for installing the movable spring plate structure 1 and at least one the fixed contact 20, and the electromagnetic structure 22 is installed at the base 21 and configured to be corresponsive to the movable spring plate structure 1. In addition, an end of the pushing assembly 23 is coupled to the soft spring plate force-applying portion 12.

In addition, the electromagnetic structure 22 further comprises a driving member 221 with an end coupled to an end of the pushing assembly 23. When the relay 2 electrically conducts to a circuit system electrically coupled to the relay 2, the electromagnetic structure 22 produces an electromagnetic effect to drive the driving member 221 and the pushing assembly 23, so that forces are exerted onto the soft spring plate force-applying portion 12 coupled to an end of the pushing assembly 23.

Figure 3A:
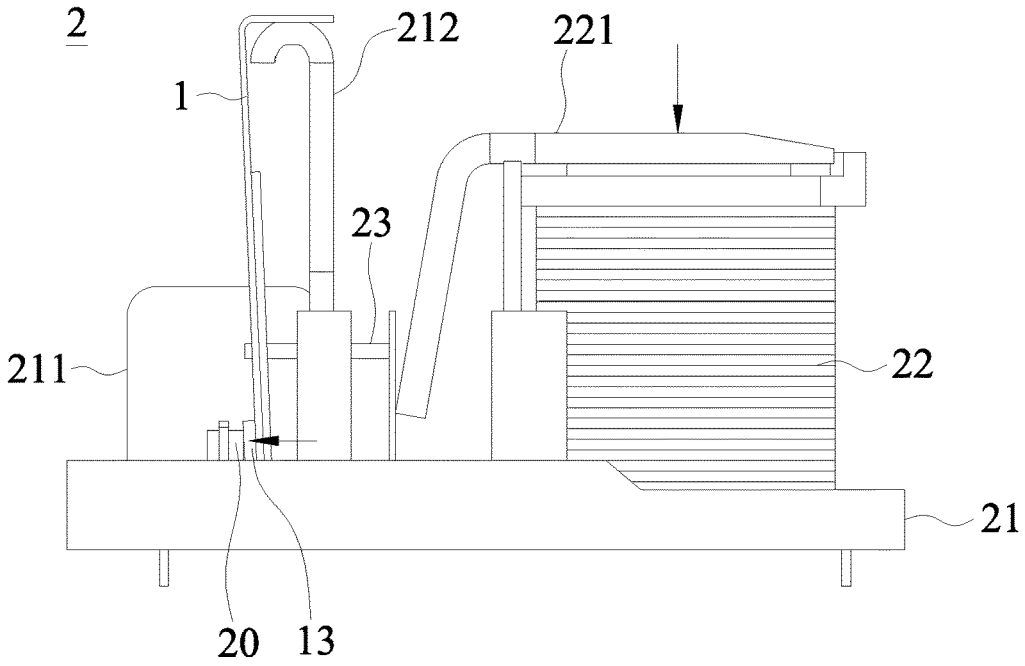
FIG. 3A, is a schematic view showing a using status of a preferred embodiment of the present invention.

When the pushing assembly 23 applies a force to the soft spring plate force-applying portion 12, the movable spring plate structure 1 is warped, and the movable contact 13 is pushed to the fixed contact 20 and contacts with the fixed contact 20 to define a closed state as shown in FIG. 3A, so that the circuit system electrically coupled to the relay 2 can be conducted.

Further, when the soft spring plate force-applying portion 12 receives a force, the soft spring plate warp portion 11 has a hardness smaller than the hardness of the rigid spring plate contact portion 10, so that the amount of deformation caused by the external force will focus on the soft spring plate warp portion 11, and the first deformation gap 111 will prevent the deformation spaces between the soft spring plate warp portion 11 and the rigid spring plate contact portion 10 from interfering with one another. In other words, the first deformation gap 111 provides the soft spring plate warp portion 11 to produce a deformation, and the rigid spring plate contact portion 10 can maintain its original status, so that the contact devices are engaged stably. Since the movable spring plate structure 1 has a flexible feature, therefore when the movable spring plate structure 1 is driven by a force, and the contact devices are engaged with each other, the movable spring plate structure 1 is deformed by the force to produce a deformation elasticity, so as to engage the contact devices more securely. With the flexibility of the movable spring plate structure 1 and the rigidity of the rigid spring plate contact portion 10, the rigid spring plate contact portion 10 produces the smallest deformation, and the movable contact 13 can be contacted with the fixed contact 20 securely to define a closed state, so as to extinguish the electric arc.

In addition, the movable spring plate structure 1 further comprises a second deformation gap 102 formed at the rigid spring plate contact portion 10 and configured to be adjacent to the movable contact 13. Particularly, at the moment of forming an open or closed state of the contact devices, the second deformation gap 102 provides a deformation space for the rigid spring plate contact portion 10 to prevent the movable contact 13 from deformation. Further, the soft spring plate warp portion 11 will produce most of the deformation, and the deformation formed by the rigid spring plate contact portion 10 is withstood by the second deformation gap 102 to prevent the deformation of the adjacent movable contact 13 and prevent any unstable situation or dislocation when the movable contact 13 and the fixed contact 20 are situated at an open or closed state. Therefore, the invention can further help the movable contact 13 to extinguish the electric arc.

In this embodiment, the second deformation gap 102 is in an arc shape and communicated to the first deformation gap 111 and surrounds the movable contact 13. Particularly, if the movable contact 13 is in a circular shape as shown in this embodiment, a more flexible deformation space is provided for the rigid spring plate portion 10 to prevent the movable contact 13 from being deformed or unstable.

Figure 3B:
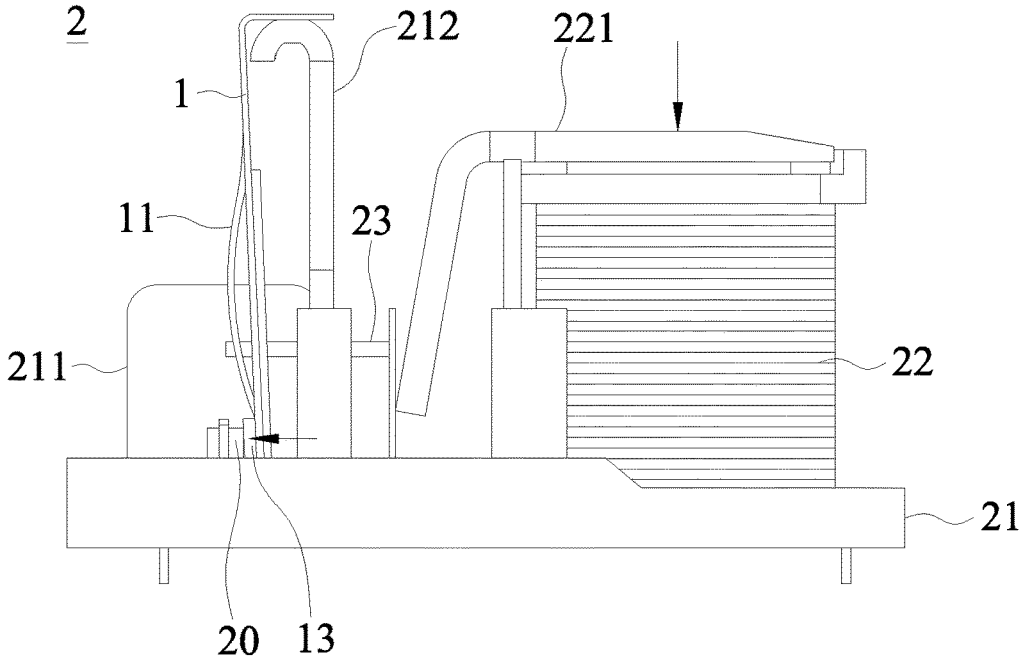
FIG. 3B, is another schematic view showing a using status of a preferred embodiment of the present invention.

Further, when a circuit electrically coupled to the relay 2 is applied to a high current or high voltage circuit and situated at an electrical conduction state, the electromagnetic structure 22 has to produce a larger electromagnetic effect and the contacts are subjected to larger force. As a result, the movable spring plate structure 1 may be deformed or dispositioned severely. The first deformation gap 111 communicated to the second deformation gap 102 is provided, so that a part of the amount of deformation of the rigid spring plate contact portion 10 is withstood by the soft spring plate warp portion 11, and the deformation space of the soft spring plate warp portion 11 is increased as shown in FIG. 3B. Therefore, the relay 2 can be miniaturized and applied to high current or high voltage systems, while preventing the contact devices at an open or closed state from producing abnormal discharges instantaneously to protect the contact devices and the circuit systems which are electrically coupled to the contact devices.

In another implementation mode, the second deformation gap 102 is in an arc shape and not communicated to the first deformation gap 111 and surrounds the movable contact 13. Similarly, the second deformation gap 102 provides an elastic deformation space of the rigid spring plate contact portion 10 to enhance the secured connection and separation with the fixed contact 20.

Figure 3C:
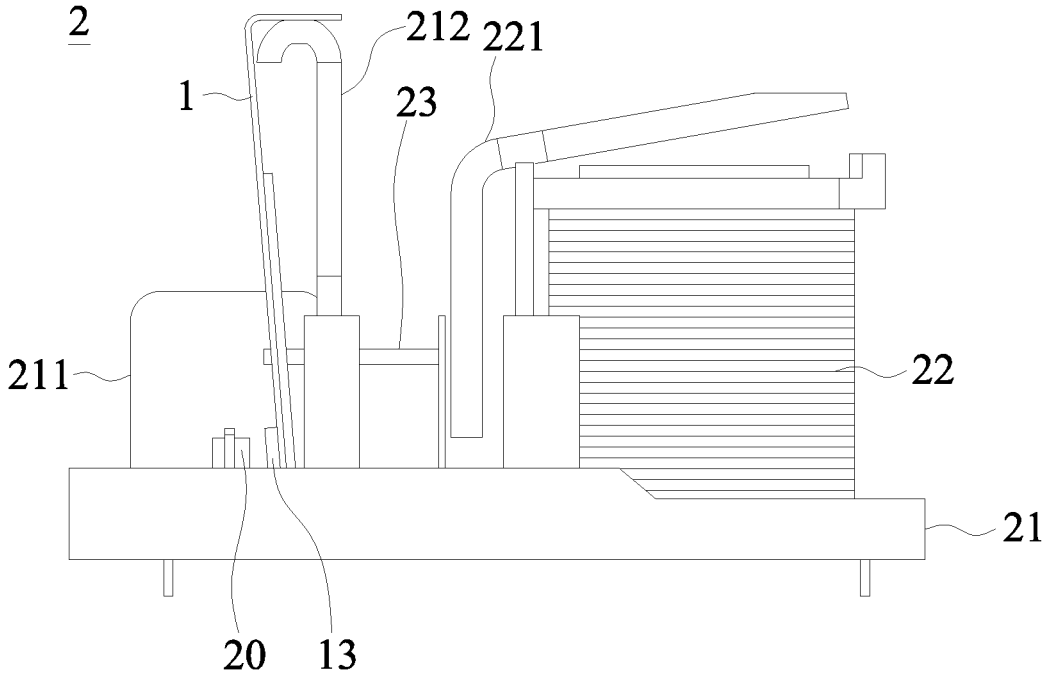
FIG. 3C, is another schematic view showing a using status of a preferred embodiment of the present invention.

Similarly, when it is necessary to disconnect the circuit system electrically coupled to the relay 2, the electromagnetic effect of the electromagnetic structure 22 disappears, so that the driving member 221 is no longer attracted by the electromagnetic force, and the pushing assembly 23 is driven by another restoring force. The soft spring plate force-applying portion 12 is pulled by the pushing assembly 23, so that the whole movable spring plate structure 1 is driven to set the contact devices into an open or closed state as shown in FIG. 3C and the circuit system into a circuit disconnection state. Similarly, when the movable spring plate structure 1 is driven, the first deformation gap 111 and the second deformation gap 102 withstand the deformation during the operation to protect the movable contact 13.

In addition, the rigid spring plate contact portion 10 is a plate 101 stacked on a part of the soft spring plate warp portion 11. In other words, the rigid spring plate contact portion 10 is a part of the soft spring plate warp portion 11 stacked on the plate 101. Therefore, the usage of two different materials can be avoided to facilitate the production process. In addition, the plate 101 has a hardness greater than the hardness of the soft spring plate warp portion 11, so that the rigid spring plate contact portion 10 will not be deformed easily when a force is applied to it, and the movable contact 13 can be secured. When the relay 2 is applied to a circuit system with high current or high voltage during an electrical conduction state, the stability of the contact device can be improved.

Preferably, the movable spring plate structure 1 further comprises a connecting portion 14 coupled to the soft spring plate warp portion 11, wherein the connecting portion 14 has a hardness smaller than the hardness of the rigid spring plate contact portion 10 and it is L-shaped. In addition, an end of the connecting portion 14 is coupled to a fastener 212 and disposed at the base 21 for installing the movable spring plate structure 1 to the base 21. Therefore, when a force is applied to the soft spring plate warp portion 11, the connecting portion 14 will be moved or deformed altogether to absorb the force exerted to the soft spring plate warp portion 11 and increase its deformation space.

In addition, the relay 2 further comprises a fastener 212 disposed at the base 21 and having an end coupled to the movable spring plate structure 1, for electrically conducting the movable spring plate structure 1, wherein the fastener 212 and the movable spring plate structure 1 form an U-shaped structure. Therefore, when the contact devices of the relay 2 are situated at a closed state, the fastener 212 and the movable spring plate structure 1 has currents in opposite directions, so that a repulsion is produced between the fastener 212 and the movable spring plate structure 1, and an electromagnetic force parallelly pushing the movable contact 13 is produced to offset the electromagnetic repulsion between the contact devices, so as to further improve the stability of the contact devices at a closed state and avoid generating an electric arc when they are separated by the repulsion.

Further in this embodiment, if the movable spring plate structure 1 comes with a plural quantity, the base 21 further comprises at least one spacer 211 for separating any two adjacent movable spring plate structures 1. The spacer 211 is capable of isolating the electric arc between two adjacent contact devices and reducing the distance between the movable spring plate structures 1 to miniaturize the relay 2.

In summation of the description above, the movable spring plate structure 1 and its relay 2 in accordance with the present invention extinguish the electric arc of the relay 2 by using the movable spring plate structure 1. Wherein, the movable contact 13 and the fixed contact 20 can be set to an open or closed state securely, and the fastener 212 is capable of setting the contact devices at a closed state securely. Further, the first deformation gap 111 and the second deformation gap 102 are provided to give a more elastic deformation space of the soft spring plate warp portion 11, so that the movable contact 13 and the fixed contact 20 can be set into the open or closed state much better, particularly for the application of the relay 2 in a circuit system of high current or high voltage. The invention can extinguish electric arcs to minimize the damage to the aforementioned contact devices, so as to improve the performance and life of the relay 2.

What is claimed is:

1. A movable spring plate structure used in a relay, for defining an open or closed state with respect to a fixed contact, comprising:

a rigid spring plate contact portion;

a soft spring plate warp portion, coupled to the rigid spring plate contact portion, and having a first deformation gap formed between the rigid spring plate contact portion and the soft spring plate warp portion, and the rigid spring plate contact portion having a hardness greater than a hardness of the soft spring plate warp portion;

a soft spring plate force-applying portion, disposed at the soft spring plate warp portion; and a movable contact, disposed at the rigid spring plate contact portion;

wherein, when the soft spring plate force-applying portion is driven by a force, and the movable contact and the fixed contact are set into a closed state, the soft spring plate warp portion produces a deformation with respect to the rigid spring plate contact portion.

2. The movable spring plate structure of claim 1, wherein the rigid spring plate contact portion is a plate stacked on a part of the soft spring plate warp portion, and the plate has a hardness greater than the hardness of the soft spring plate warp portion.

3. The movable spring plate structure of claim 2, further comprising a second deformation gap disposed at the rigid spring plate contact portion and configured to be adjacent to the movable contact.

4. The movable spring plate structure of claim 3, wherein the second deformation gap is in an arc shape and communicated to the first deformation gap and surrounds the movable contact.

5. The movable spring plate structure of claim 3, wherein the second deformation gap is in an arc shape and not communicated to the first deformation gap and surrounds the movable contact.

6. The movable spring plate structure of claim 4, further comprising a connecting portion coupled to the soft spring plate warp portion, and the connecting portion having a hardness smaller than the hardness of the rigid spring plate contact portion and being L-shaped.

7. A relay, comprising:

at least one movable spring plate structure used in a relay, for defining an open or closed state with respect to a fixed contact, and the movable spring plate structure comprising:

a rigid spring plate contact portion;

a soft spring plate warp portion, coupled to the rigid spring plate contact portion, and having a first deformation gap formed between the rigid spring plate contact portion and the soft spring plate warp portion, and the rigid spring plate contact portion having a hardness greater than a hardness of the soft spring plate warp portion;

a soft spring plate force-applying portion, disposed at the soft spring plate warp portion; and a movable contact, disposed at the rigid spring plate contact portion;

wherein, when the soft spring plate force-applying portion is driven by a force, and the movable contact and the fixed contact form a closed state, the soft spring plate warp portion produces a deformation with respect to the rigid spring plate contact portion;

a base, for installing the movable spring plate structure and the fixed contact;

at least one electromagnetic structure, disposed at the base, and configured to be corresponsive to the movable spring plate structure; and at least one pushing assembly, with an end coupled to the soft spring plate force-applying portion; and the electromagnetic effect of the least one electromagnetic structure magnetically attracting and driving the movable contact and the fixed contact into an open or closed state after an electrical conduction.

8. The relay of claim 7, further comprising a fastener, disposed at the base and having an end coupled to the movable spring plate structure, and having a current in an opposite direction when electrically conducted with the movable spring plate structure, so as to produce an electromagnetic force that pushes in a parallel direction towards the movable contact to improve the stability between the movable contact and the fixed contact.

9. The relay of claim 8, wherein if the movable spring plate structure comes with a plural quantity, the base further comprises at least one spacer for separating any two adjacent movable spring plate structures.

* * * * *